United States Patent [19]

Chancellor

[11] 4,184,417

[45] Jan. 22, 1980

[54] PLUME ELIMINATION MECHANISM

[75] Inventor: Richard A. Chancellor, Dearborn, Mich.

[73] Assignee: Ford Motor Company, Dearborn, Mich.

[21] Appl. No.: 856,698

[22] Filed: Dec. 2, 1977

[51] Int. Cl.[2] ..... F23L 17/02; F23J 13/00

[52] U.S. Cl. ..... 98/58; 98/60; 98/66 R; 110/184; 417/155

[58] Field of Search ..... 98/58–60, 98/66 R, 66 A, 45, 46; 110/184; 431/5, 10, 202; 417/155

[56] References Cited

U.S. PATENT DOCUMENTS

| | | | |
|---|---|---|---|
| 603,881 | 5/1898 | Kuphal | 98/66 R |
| 2,055,526 | 9/1936 | Giesl-Gieslinger | 417/155 |
| 2,397,870 | 4/1946 | Kneass, Jr. | 417/155 |
| 3,115,820 | 12/1963 | Adelt | 98/60 |
| 3,566,768 | 3/1971 | Walpole, Jr. | 98/58 |
| 3,606,847 | 9/1971 | Reilly | 98/58 |
| 3,693,883 | 9/1972 | Stigger | 98/58 |
| 3,719,032 | 3/1973 | Cash | 98/66 R |
| 3,893,810 | 7/1975 | Lientz | 431/5 |
| 4,084,935 | 4/1978 | Reed et al. | 431/202 |
| 4,149,453 | 4/1979 | Reed | 98/58 |

FOREIGN PATENT DOCUMENTS

| | | | |
|---|---|---|---|
| 481341 | 3/1938 | United Kingdom | 98/60 |

*Primary Examiner*—Henry C. Yuen

*Attorney, Agent, or Firm*—Joseph W. Malleck; Olin B. Johnson

[57] ABSTRACT

A discharge apparatus for dispersing exhaust gases discharged into the atmosphere and eliminating the steam plume, is disclosed. A plurality of conical diffusing elements are supported in spaced nested relationship along the discharge axis of the exhaust duct. Continuous compressed air is ejected into the central portion of each conical diffusing element.

6 Claims, 2 Drawing Figures

PLUME ELIMINATION MECHANISM

BACKGROUND OF THE INVENTION

Discharge stacks have been employed by industry to discharge hot gases into the atmosphere. Due to federal and state regulations, the noxious effluent in these gases has been considerably reduced but water vapor or other permissible elements tend to form an exhaust plume eminating from the top open end of the exhaust stack. It is desirable that such exhaust gas discharge and plume be dispersed in such a manner that the gaseous content is homogenized quickly into the atmospheric mass and cooled so as to eliminate condensation which would inhibit a broader dispersion of the exhaust gases.

Attempts by the prior art to provide for dispersion of exhaust gas discharges have included (a) the use of air shrouding or air curtains entraining the central flow of exhaust gases, (b) the pulsation of the exhaust gases such as by pulsed injections of air to create gas rings having a greater buoyancy to rise into the atmosphere for better dispersion, and (c) the use of aspirated air or blower driven air to shroud the gas flow as it leaves the top of the exhaust stack.

None of these approaches by the prior art have provided a satisfactory dispersion of exhaust gases so as to eliminate any plume that might eminate from the stack as a result of the pressure, temperature, and moisture conditions of the exhaust gases.

SUMMARY OF THE INVENTION

A primary object of this invention is to provide an apparatus for diluting exhaust gas flow with ambient air in such a manner that the density of any plume eminating from the discharge stack is dissipated instantly resulting in a high degree of diffusion of exhaust gases into the atmosphere.

Yet still another object of this invention is to provide for such dispersion and diffusion of exhaust gases from a discharge stack by an apparatus which is relatively easy to make and assemble and is highly economical.

Features pursuant to the above objects comprise the use of (a) at least two concentrically aligned conical sheet metal members which are spaced from and aligned with the formation of a complimentary conical member forming the end of the exhaust stack; (b) the use of a plurality of compressed air jets aligned along the axis of said cones with one disposed in the mid portion of each of said conical member; and (c) controls for continuously supplying compressed air to said jets so that the exhaust gas flow and jets of compressed air converge centrally therein, causing a high degree of aspiration of ambient air to be drawn between and into overlapping portions of said conical members forcing a high degree of aspiration, mixing and proper dispersion.

DETAILED DESCRIPTION

Figure 1:
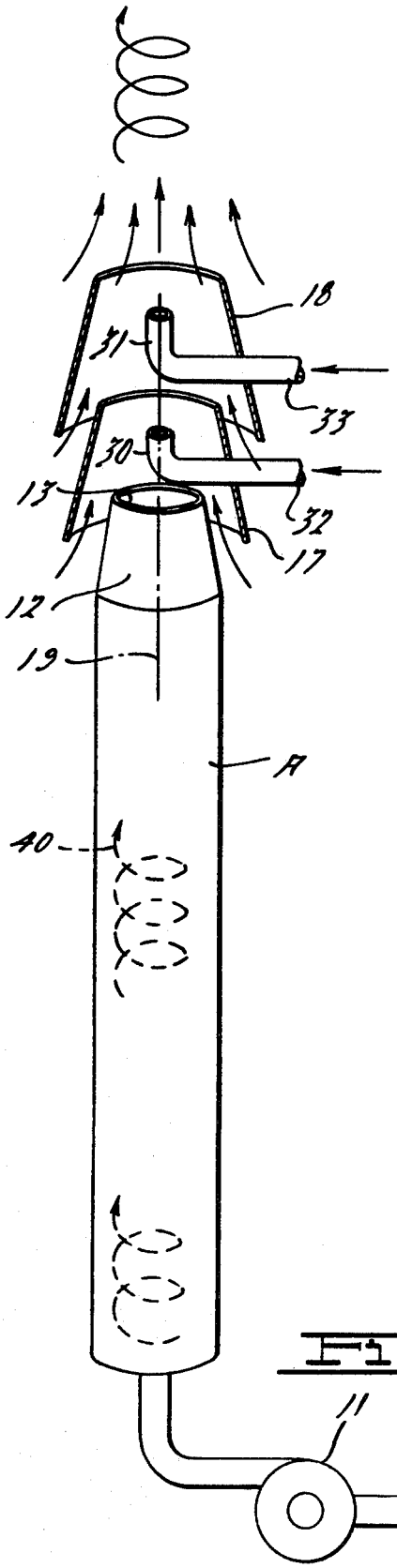
FIG. 1 is a schematic illustration of an industrial exhaust gas discharge apparatus incorporating the features of this invention.
Figure 2:
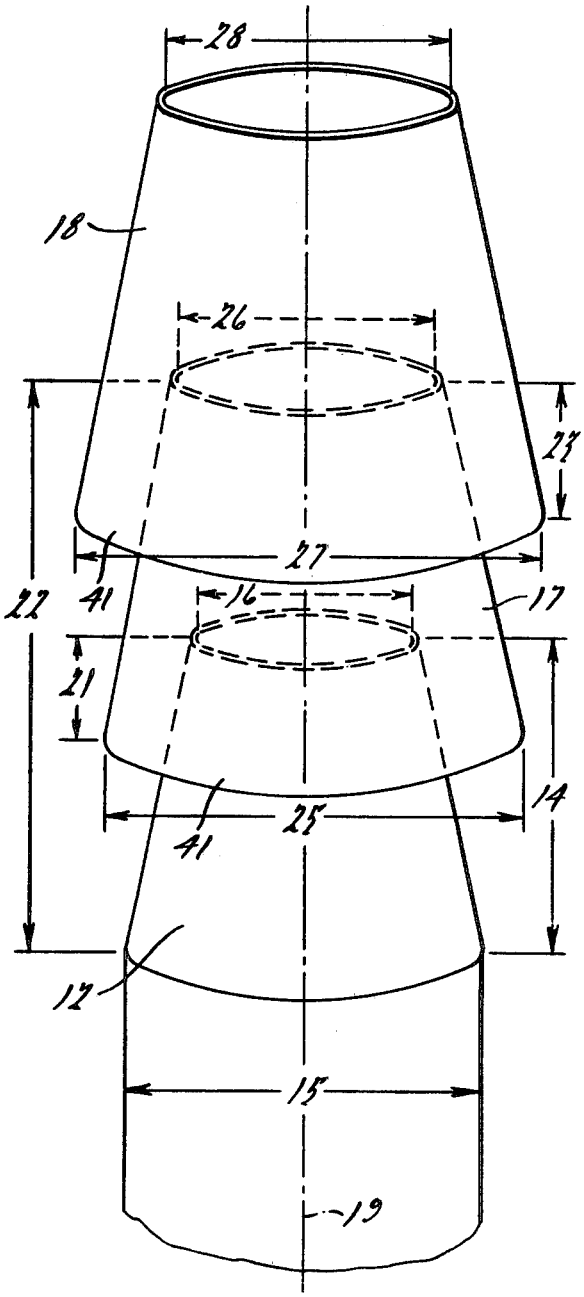
FIG. 2 is an enlarged view of a portion of the apparatus in FIG. 1 illustrating the nexted conical members providing for air aspiration.

Turning now to the Figures, the discharge apparatus for this invention generally comprises a discharge stack A having a duct generally vertically oriented. The stack receives a flow of discharged gases from other industrial equipment (not shown) such as a furnace, a moisture eliminator, or other emission control equipment. The path 10 along which the exhaust gases are conveyed to the duct A (from a typical cupola) contains a fan 11 for driving the exhaust gases therealong at a rate of at least 78,100 c.f.m. The duct illustrated has an internal diameter of 68 inches and a length of about 100 feet for conveying a gas flow at said c.f.m.

A duct A is formed with a conical diffusing section 12 at the upper end 13 thereof. Section 12 should have a taper of about 10.5 degrees; in this embodiment the segment height 14 is about 61.2 inches and the inlet and outlet diameters, 15 and 16 respectively, are 68 and 45.3 inches.

Diffusing cones 17 and 18, complimentary in configuration to section 12, are nested thereover. The diffusing cones 15 and 16, and the conical section 12 are each aligned along the center line 19 or axis of flow of said exhaust gases; each are spaced along said axis so that the upper end 20 of the lowermost discharge section 12 intrudes or penetrates a distance 21 of the next cone 17, which is approximately 20 to 30% of the interior height 22 thereof. Similarly cone 17 penetrates interiorily of cone 18 a distance 23 which provides an overlapping relationship. For purposes of this embodiment, the inlet and outlet diameter (25 and 26) of cone 17 are 85.4 and 71.2"; the inlet and outlet diameters (27 and 28) of cone 18 are 108.2 and 86.6".

The diameters and heights of each of said diffusing cones are related to the principal diamater 15 of the exhaust stack. The principal diameter 15 of the exhaust stack is approximately 1.5 times greater than the outlet diameter 15 of the stack. The height of the conical section 12 is approximately 1.5 times greater than the outlet diameter 15 of the stack. The height of the conical section 12 is approximately the same as the principal diameter 15. The approximate relationship of diameter 25 to diameter 15 is 1.26 and the ratio of diameter 27 to diameter 25 is about 1.27.

Nozzles 30 and 31 are located respectively in the central interior of cones 17 and 18. Each nozzle is oriented to inject a pressurized air stream in a direction aligned with axis 19. The supply tube 32 and 33 for said nozzles extends through the wall of said conical sections and is effective to carry compressed air typically at 7–8.1 psi.

In operation, the exhaust gases should be delivered to the exhaust stack driven at a flow of not greater than approximately 80,000 c.f.m. by the fan. As the exhaust gases travel through the series of hollow diffusing cones, aa continuous discharge of compressed air is introduced centrally and along the axis of the flow 40 in each of said diffusing members. Pressure created within the conical members adjacent the exit mouth is substantially lowered as a result of the increase in velocity of the flow 40 and this aspirates or draws air in through the spacing 41 located between the adjacent cones inlet and outlet. A suggested theory of why rapid dilution and dispersion of exhaust gases substantially eliminates a plume, based upon thermodynamics, is as follows: reduce the relative humidity and water content of the exhaust by dilution and by adequate homogeneous mixing.

Based upon the foregoing description, what is claimed is:

1. A discharge apparatus for hot exhaust gases, comprising:

(a) a discharge stack with a vertically oriented duct having an open end at the top thereof, (b) a plurality of conical diffusing members supported adjacent the open end and concentric about the axis of said duct, said diffusing members being spaced longitudinally apart a distance along said axis, each of said diffusing members beong open at opposite ends thereof with the upper end of each member being nested within but spaced from the lower end of the most adjacent conical member, and (c) means providing for injection of a continuous jet of compressed air into each of said diffusing members, said jets being aligned with the axis of the associated diffusing member whereby the flow of exhaust gases exiting from said open stack top is cooled by said jets, diluted by the ambient air aspirated into and between said conical members and dispersed homogenously into the general mass of the atmosphere without the formation of a visible plume.

2. A discharge apparatus as in claim 1, in which means is provided for moving the exhaust gases upwardly through said discharge duct at a rate of no greater than 80,000 c.f.m., and in which the compressed air discharged by said jet is at a pressure range of 7–8.1 psi.

3. A discharge apparatus as in claim 1, in which the conical diffusing members each having configuration in which the lower diameter of each of said diffusing member is progressively increased the more remote the conical diffusing member is stationed from the duct, and in which the height of each of said conical diffusing members is generally about the same as the inlet diameter for each of said cones.

4. The apparatus as in claim 1, in which the means providing for said jets is arranged so that a nozzle for injecting compresses air is located substantially midway along the height of each of said cones.

5. The apparatus as in claim 1, in which the conical taper of each of said conical diffusing members is 8°–12°.

6. The apparatus as in claim 1, in which the penetration of the lower diffusing element into the next adjacent diffusing element is about 20–30% of the interior height of the higher element.

* * * * *